US005198848A

United States Patent [19]

Tahon et al.

[11] Patent Number: 5,198,848

[45] Date of Patent: Mar. 30, 1993

[54] PROCESSING APPARATUS

[75] Inventors: Jean-Pierre D. Tahon, Leuven, Belgium; Alfons Kastl, Munich, Fed. Rep. of Germany; Stefan Osiander, Munich, Fed. Rep. of Germany; Horst Köninger, Munich, Fed. Rep. of Germany

[73] Assignee: AGFA-Gevaert N. V., Mortsel, Belgium

[21] Appl. No.: 870,242

[22] Filed: Apr. 17, 1992

[30] Foreign Application Priority Data

Apr. 26, 1991 [EP] European Pat. Off. ..... 91201010.5

[51] Int. Cl.[5] ..... G03D 3/08

[52] U.S. Cl. ..... 354/320

[58] Field of Search ..... 354/317-324, 354/331, 338, 339

[56] References Cited

U.S. PATENT DOCUMENTS 4,931,378 6/1990 Hirano et al. ..... 354/320 X 5,109,353 8/1992 Ohba et al. ..... 354/322

5,138,246 4/1992 Yamamoto et al. ..... 354/318

*Primary Examiner*—Michael L. Gellner

*Assistant Examiner*—D. Rutledge

*Attorney, Agent, or Firm*—William J. Daniel

[57] ABSTRACT

Processing apparatus for image-wise exposed light-sensitive sheets of the DTR-type, which comprises a trough (11) for processing liquid, a sloping entry guide plate (17) for guiding a sheet towards its deepest point, a pair of outlet rollers (16) for pulling a sheet at a uniform speed through the apparatus and for squeezing liquid from it and replenishing means for keeping a processing liquid in the trough at a controlled level, which apparatus is provided with a floating cover (25) arranged for floating on the free surface of the processing liquid, and means for maintaining between the rear edge of the floating cover and the rear end of the trough a space (41) sufficient to allow unhindered passage of a processed sheet towards the outlet rollers.

10 Claims, 6 Drawing Sheets

PROCESSING APPARATUS

BACKGROUND OF THE INVENTION

1. Field of the Invention

The present invention relates to a method for the production of photographic images in accordance with the DTR (silver halide diffusion transfer) method and to a processing apparatus for carrying out this method.

2. Description of the Prior Art

The principles of the photographic silver complex diffusion transfer reversal process, herein called DTR-process wherein DTR stands for diffusion transfer reversal, have been described e.g. in U.S. Pat. No. 2,352,014.

In the DTR-process, silver complexes are image-wise transferred by diffusion from an image-wise exposed and developed silver halide emulsion layer to an image-receiving layer, where they are converted into a silver image. For this purpose, an image-wise exposed silver halide emulsion layer is developed by means of a developing substance in the presence of a so-called silver halide solvent. In the exposed parts of the silver halide emulsion layer, the silver halide is developed to silver so that it cannot dissolve anymore and thus cannot diffuse. In the non-exposed parts of the silver halide emulsion layer, the silver halide is converted into soluble silver complexes by means of a silver halide complexing agent (a so-called silver halide solvent) and transferred by diffusion into an image receiving layer arranged or kept in waterpermeable relationship with the silver halide emulsion layer to form in the image-receiving layer, usually in the presence of development nuclei, a silver metal image. More details on the DTR-process can be found in the book "Photographic Silver Halide Diffusion Processes" by A. Rott and E. Weyde, Focal Press, London, New York (1972).

In a particular DTR-system, the image-receiving layer forms an integral part of the photographic material, in other words forms a mono-sheet system. In said mono-sheet system, the image-receiving layer is separated from the silver halide emulsion layer by an opaque but waterpermeable layer. The opaque layer precludes the detection by the eye of a silver image formed in the silver halide emulsion layer. Examples of opaque pigment layers suited for the above purpose are described in DE-B1 1,961,030, DE-A1 1,772,603, in BE-A1 526,587, in GB-A 878,064 and in U.S. Pat. No. 3,928,037.

The processing of image-wise exposed DTR-type materials occurs almost universally by conveying the exposed light-sensitive sheet along a concavely curved path through a body of processing liquid contained in a trough. At its exit a roller pair for pulling the sheet(s) at a uniform speed through the liquid and for squeezing the sheet(s), thus removing most of the liquid in order to enable a quick drying of the sheet(s), is provided. In the case of a two-sheet system, the outlet roller pair also ensures the tight contact between both sheets to enable the transfer of the soluble silver complexes from the light-sensitive towards the image-receiving sheet.

Apparatus for carrying out the described process are simple and rugged of construction and reliable from a mechanical point of view. They comprise a trough for the processing liquid, the bottom wall of this trough being concavely curved to serve as a sheet guide, a sloping entry guide plate for guiding the sheet towards the deepest point of the trough and a pair of outlet rollers for pulling the sheet at a uniform speed through the apparatus and for squeezing liquid from it.

The consistency of processing results obtained with these known apparatus leaves much to be desired, since it has been shown that after a period of use of approximately one week, the processing liquid of the apparatus has deteriorated such that the quality of the processed images becomes unsatisfactory. This deterioration is caused by different factors. First, the absorption by the liquid in the trough of $CO_2$ from the air. Next, evaporation which causes the concentration of the processing liquid to change and, finally, oxidation to the air. So the processing liquid in the apparatus has to be replaced at least after approximately one week, independent of the number of developments carried out. This replacement is not only time consuming and expensive, but also produces a large number of empty bottles from the fresh processing liquid and a serious amount of unusable processing liquid to be destroyed in an ecologically acceptable way.

It has been proposed to overcome deterioration of the processing liquid by providing a rigid cover on the free surface of the liquid in the trough and by compensating liquid carried off by processed sheets through a replenishing system, such as a barometric feeding arrangement. Such system is disclosed in U.S. Pat. No. 3,148,611.

The operation of this system is critical since the slightest deviation of the apparatus from a truely horizontal position breaks the contact of the surface cover with the free liquid surface in the trough. Liquid leaking onto the cover remains in place and deteriorates on the air. Finally displacements or tilting of the apparatus can produce air bubbles remaining captured under the cover.

Photographic processors are known in which floats are used to reduce the free surface of the processing liquid. However, such processors have separate storage tanks with parallel walls so that varying liquid levels do not impede the proper working of the floats as they are free to go up and down with the liquid in the tank.

SUMMARY OF THE INVENTION

Objects of the Invention

It is the object of the present invention to provide an improved processing apparatus that allows a much longer use of the processing liquid by suitable reduction of the liquid surface which is exposed to the air.

In accordance with the present invention, a processing apparatus for processing an image-wise exposed silver salt diffusion transfer sheet material comprising a trough for processing liquid, the bottom wall of which is concavely curved to serve as a guide for a sheet through the liquid in the trough, the trough being provided with a sloping entry guide plate for directing a sheet towards the deepest point of the trough, and a pair of outlet rollers for pulling a sheet at a uniform speed through the apparatus and for squeezing liquid from it and replenishing means for keeping a processing liquid in the trough at a controlled level, is characterised thereby that it comprises a floating cover arranged for floating on the free surface of the processing liquid extending between the rear end of the trough and the guide plate and means for maintaining between the rear side of the floating cover and the corresponding rear end of the trough a spacing with a sufficient clearance to allow passage of a sheet along the bottom wall towards the outlet rollers.

The advantages of the improved apparatus over one without a cover in contact with the liquid are as follows.

The comsumption of processing liquid can be reduced by a factor of at least 1.4 for activator and at least 2.0 for developer solution. This is a direct consequence of the important reduction of the free surface of the processing liquid so that former use periods of approximately one week can now be extended to a range of 4 to 12 weeks and even longer. This causes a serious reduction of packaging material since less fresh liquid means less bottles or jerrycans that must be disposed. Also there is much less used processing liquid that must be disposed.

Furthermore, there is an important improvement in user-friendliness since maintenance of the apparatus is now extended from about one week to a plurality of weeks. Maintenance does not only mean the replacement of the used processing liquid by a fresh one, but also the cleaning and rinsing of the apparatus. Since the chemical composition of the processing liquid remains much more constant in time, the consistency of quality of the processed images is correspondingly improved. Finally, the horizontal adjustment of the apparatus is less critical.

Preferred but optional features of the apparatus according to the invention are as follows.

The spacing means is formed by a protrusion at each corner of the rear edge of the floating cover.

The front and rear sides of the floating cover are bevelled and taper in downward direction.

The top surface of the floating cover has a shape tapering downwardly towards the edges so that any liquid leaking on the cover flows off into the body of processing solution in the trough.

The floating cover has a lateral extension covering a corresponding lateral extension of the trough for its emptying.

The floating cover has a grip for easy removal of the cover from the trough.

The present invention includes also a method for producing images according to the DTR process.

In accordance with the present invention, a method for the production of photographic images in accordance with the silver salt diffustion transfer process wherein an image-wise exposed light-sensitive sheet is processed by introduction into a body of processing liquid contained in an open trough by means of a slanting guide at the entry of the trough and by its conveyance trough said body of processing liquid along a concavely curved path, is characterised by the steps of reducing the free liquid surface comprised between its line of intersection with the sheet guide plate and the rear end of the trough by floating means closely spaced from the adjacent walls of the holder, and by controlling the level of the processing liquid in the trough to keep the vertical position of the floating means in the trough constant.

According to a preferred embodiment of the invention, the level of the processing liquid is controlled in such a way that deviations thereof are smaller than 1.5 mm. A suitable means for performing such control is a bird's fountain system.

BRIEF DESCRIPTION OF THE DRAWINGS

The invention will be described hereinafter by way of example with reference to the accompanying drawings wherein.

DETAILED DESCRIPTION OF THE INVENTION

Figure 1:
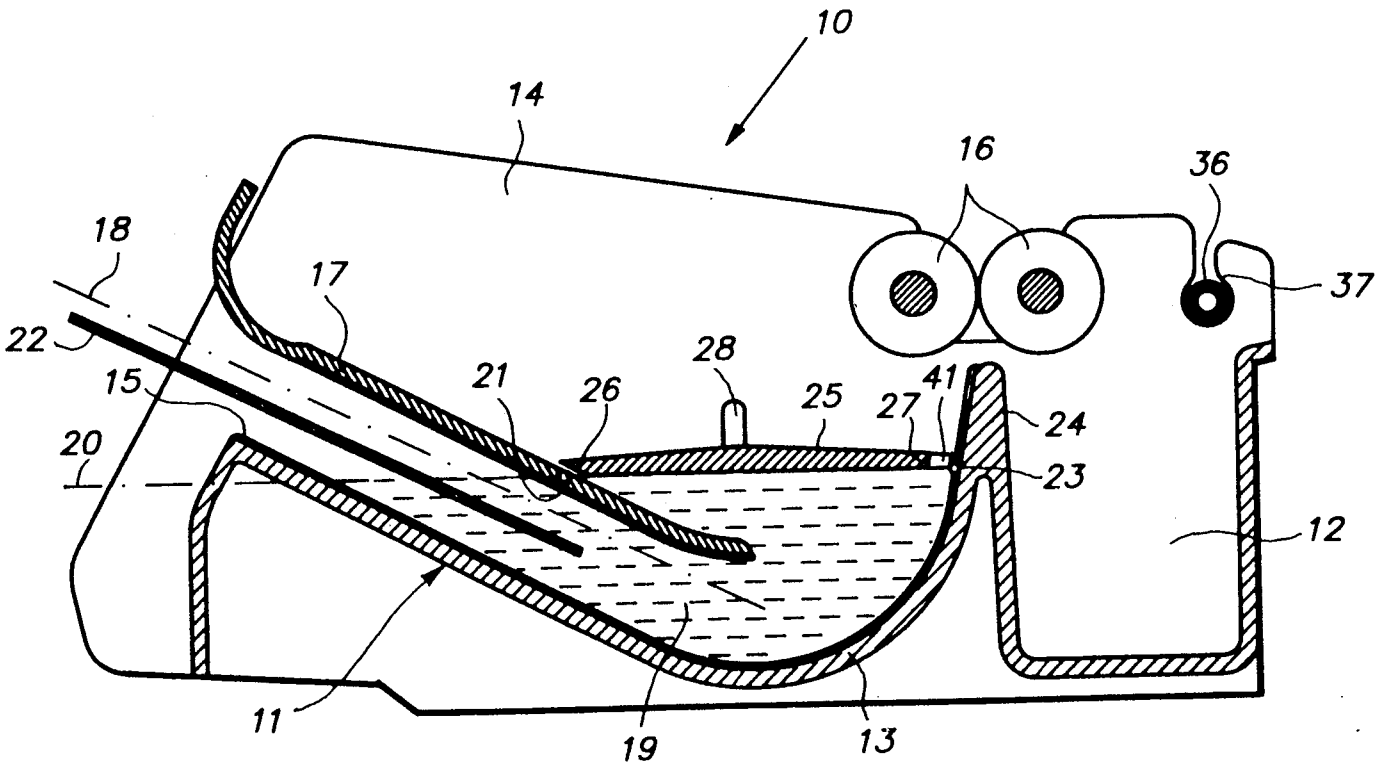
FIG. 1 is a diagrammatic cross-sectional view of one embodiment of an apparatus according to the invention, on line 1—1 of FIG. 2.

The apparatus shown in cross-section in FIG. 1 is intended for carrying out the silver salt diffusion transfer process by means of an image-wise exposed negative sheet and a positive sheet onto which the non-exposed parts of the negative are transferred.

The apparatus comprises a generally rectangular housing 10, in which a trough 11 for holding a body of processing liquid 19 is mounted. An end section 12 is integrally moulded with the trough 11 and serves to collect processing liquid that leaks in operation from the rear roller of the outlet roller pair.

The trough is formed by a concavely curved bottom wall 13 and two flat side walls, one being visible as 14 in the figure.

Laterally spaced arcuate ribs 15 on the bottom wall reduce the surface contact of a sheet with the wall.

The apparatus comprises resilient outlet pressure rollers 16 for pulling a sheet at a uniform speed through the processing liquid and for squeezing the adherent liquid from the sheet, which will flow back into the liquid in the trough.

A sheet guide plate 17 is provided at the inlet end of the apparatus and runs downward thereby directing a sheet (usually the image-wise exposed negative sheet) approximately along a path indicated by line 18 to the deepest point of the trough.

A separator plate 22 keeps a second sheet (the positive sheet) separated from the first one until it is sufficiently wetted by the processing liquid.

The trough described so far is preferably made by injection moulding from a plastic that is dimensionally stable and resistant against the used liquid chemicals.

The trough is in use filled with processing liquid 19 up to a level 20 controlled by a bird's fountain system to be described hereinafter. The contact between the air and the free liquid surface comprised between the lines (represented by a small circle for the sake of clearness) of intersections 21 and 23 of the liquid surface with the guide plate 17 and the rear end 24 of the bottom wall respectively, is substantially reduced by a floating cover 25 floating on the surface of the liquid.

The floating cover may be made from a material with a specific density smaller than that of the processing liquid, e.g. from a foamed plastic such as polyurethane thereby to operate as a float as shown in the present embodiment. However, the floating cover may also be made from a denser material that gets obtains its floating power from included air, such as hollow float made from a suitable plastic by rotational molding. A suitable shape for the floating cover is one which shows a top surface that smoothly tapers towards the edges as shown in FIG. 1. This has the advantage that liquid dripping on the cover, e.g. from the inward outlet roller, does not remain on the cover thus oxidizing and forming a smudge, but instantly flows into the body of liquid in the trough.

The front side 26 and the rear side 27 of the floating cover are bevelled and taper in downward direction as shown, whereby optimum reduction of free air passage towards the free liquid surface is obtained. The lateral sides of the floating cover run vertically. Finally, the floating cover has a grip 28 for facilitating its removal from the apparatus.

Figure 2:
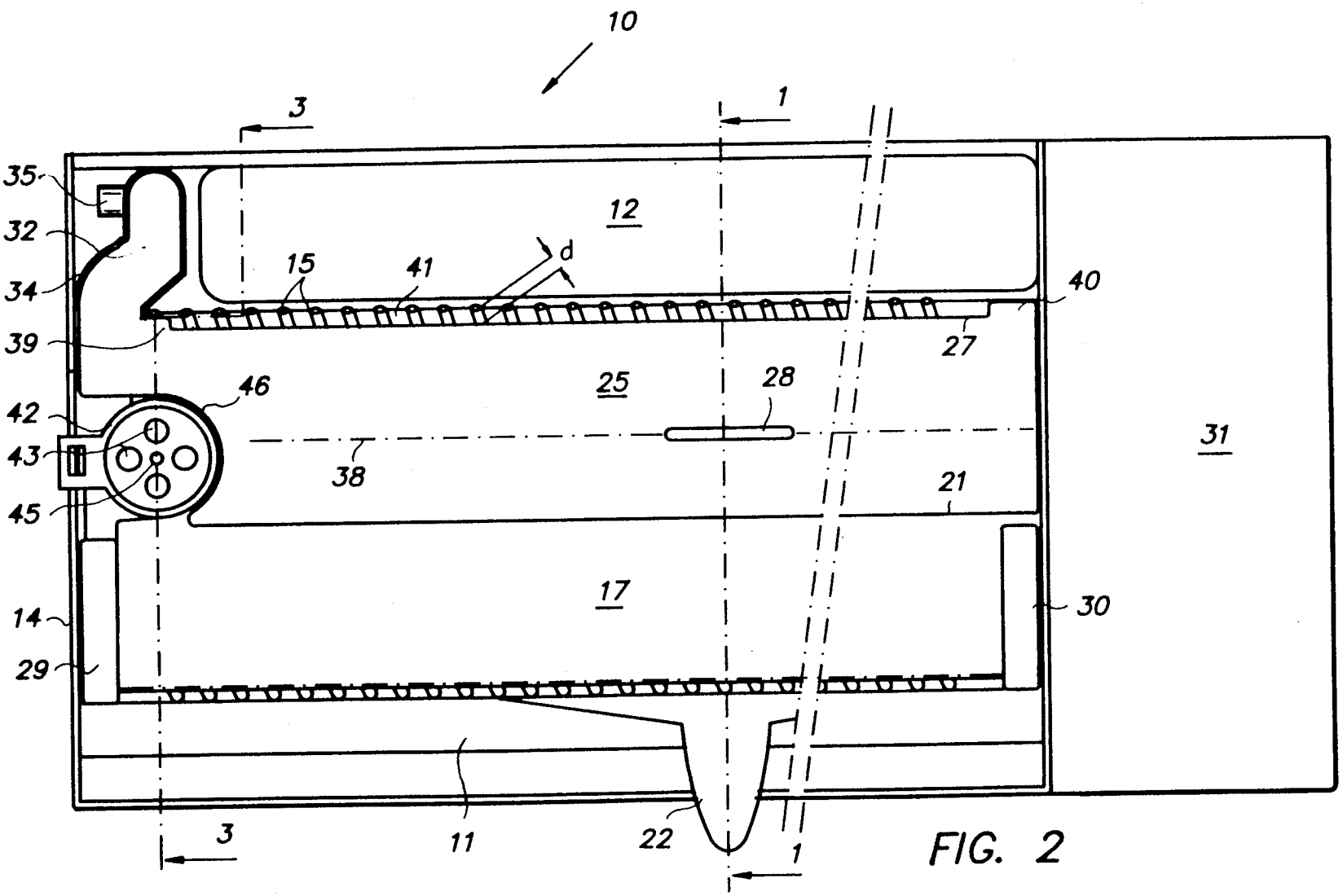
FIG. 2 is a plan view of the apparatus according to FIG. 1.

FIG. 2 shows a plan view of the apparatus, the cover of the apparatus being removed. The outlet roller pair has also been removed in order to show more clearly the location of the rear end of the floating cover and its lateral extension.

The entry end of the apparatus is provided with two slides 29 and 30 for locating guide plate 17 and separator plate 22 in the positions as shown. The guide plate 17 has at each lateral end a small straight extension that fits in said slides so that the plate may easily be withdrawn from the slides in view of the cleaning of the apparatus, this in spite of the curved lower end of the plate.

The apparatus comprises a compartment 31 with engine and gear means for driving of the outlet rollers.

Floating cover 25 is provided at its rear end, near one corner with an S-like extension 32 that serves to cover a corresponding inward extension 34 of the trough 11. The extension 34 is provided to allow the provision of an outlet pipe 35 inward of the corresponding lateral wall of the apparatus. This pipe communicates with the inside of the trough and enables its emptying without having to tilt the apparatus. Pipe 35 is closed by a flexible hose 36 (not illustrated), folded back upwardly over the extension and kept clamped in the clamp formed by an undercut opening 37 in the side wall 14 of the trough 11 (see FIG. 1).

The floating cover is finally provided at its rear end and near its corners with two extensions 39 and 40 that can enter into contact with the rear end 24 of the processing trough, or with ribs 15 thereon, and that determine in that way a slot-like opening 41 having a width d of approximately 7 millimeters in the present example allowing unhindered passage of processed sheets between the float and the wall of the trough. In the absence of the mentioned opening, sheets introduced in the trough would risk to touch the floating cover and try to tilt it when upwardly sliding over the ribs 15 to the nip of the outlet rollers 16.

Lateral wall 14 is provided inside of the apparatus with a ring-like support 42 for holding a container with replenishing liquid in inverted position above the processing trough. Support 42 has four holes 43 in its bottom wall for letting pass the outflowing liquid into the trough, and an upstanding pin 45 for opening the container as will be described in detail with reference to FIG. 3.

It should be noted that floating cover 25 has a cut out 46 that closely follows the form of support 42 thereby reducing at this location the freely exposed processing liquid surface in the trough as well.

Figure 3:
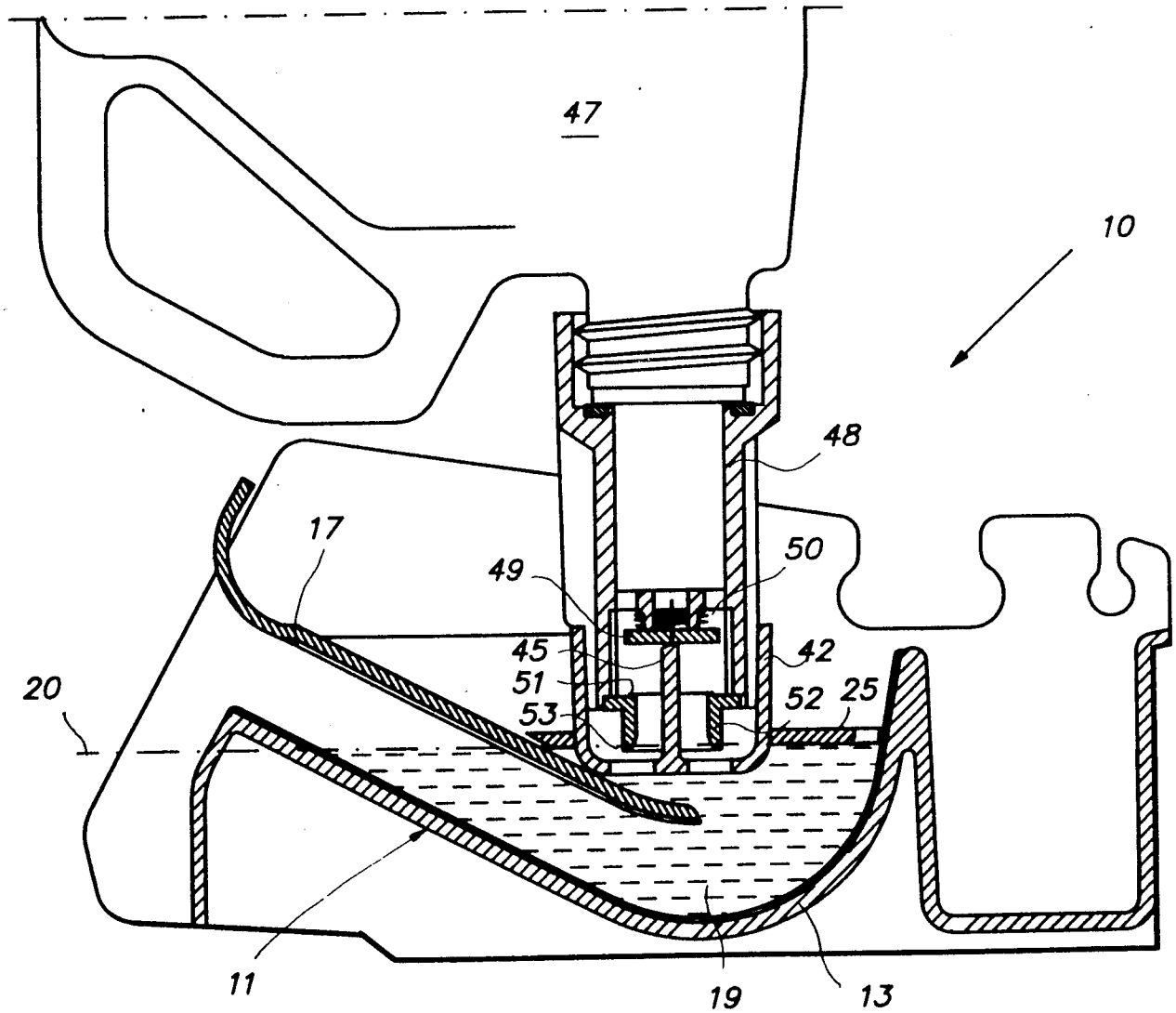
FIG. 3 is a cross-section on line 3—3 of FIG. 2.

In FIG. 3, a cross-section on line 3—3 of FIG. 2, a container in the form of an inverted jerrycan 47 that fits on support 42 of the apparatus 10 is shown. The cover of the apparatus that provides support for the jerrycan in addition to support 42 has been omitted from the figure for clearness sake.

Jerrycan 47 is provided with a spout 48 screwed on its threaded neck, and forming an adaptor between the jerrycan and support 42. The spout also combines the functions of a valve enabling the inverting of the jerrycan without loss of liquid and of a bird's fountain system.

To that end, the spout has a valve in the form of a rubber disk 49 urged by a helical spring 50 on a seat 51 formed by an inside rim of a sleeve 52 being part of the spout.

Mounting of the jerrycan on support 42 causes pin 41 to lift valve 49 whereby liquid flows in the trough.

The outside edge of sleeve 52 has a collar 53 with a tapering edge which accurately determines the level 20 of the liquid in trough 11. We have found that a bird's fountain system as disclosed in DE 3321047C2 constitutes an excellent feeding system capable of keeping the level of the liquid constant within close limits, i.e. deviations smaller than 1.5 mm.

In testing the apparatus in order to find out the behaviour of the floating cover, it was found that the normal level of the processing liquid had to be lowered by 3 mm before the floating cover came to rest on the wall of the trough.

Comparative tests have been carried out in order to illustrate the improvements that can be obtained by an apparatus according to this invention over a prior art apparatus with open trough. The prior art apparatus is a processor that is being marketed for more than 10 years by AGFA-GEVAERT N.V., Mortsel Belgium, under the trade name COPYPROOF processor, type CP 380 for the processing of COPYPROOF DTR type materials (COPYPROOF is a trade mark of Agfa-Gevaert N.V., Belgium). The apparatus had a trough capacity of 1 L of processing liquid supplied to the trough by simply emptying a 1 L bottle with processing liquid in the trough. The max. processing width was 38 cm.

The apparatus in accordance with the invention was basically the same apparatus but modified for co-operation with a bird's fountain system as illustrated in FIG. 3 and further provided with a float with a general shape as shown in FIG. 2.

The comparative examples were carried out at room temperature.

EXAMPLE 1 (WITH DEVELOPER SOLUTION)

Table 1 (represented at the end of the description of this specification) illustrates the maximum optical densities and the gradations (mentioned between brackets) measured for different types of photographic materials, processed in increasing amounts expressed in square meters, at increasing periods of use, expressed in weeks (w.), resp. days (d.), in a processor according to the invention and in a prior art one.

The negative figures of a number of gradations point to a negative image of a test wedge resulting from the use of a reversal type negative.

The characteristics of the different photographic materials were as follows.

The developer was a type CP 297 developer solution for DTR use.

CPN stands for a high-sensitive orthochromatic polyethylene coated paper to be used as a negative in optical reproduction work.

CPP stands for a polyethylene coated paper to be used as a positive for screened proofs and the like.

CPF stands for a clear polyester film to be used as a positive for transparancies for overhead projection, intermediate copies for photomechanical processors, etc.

CPRV stands for a high-sensitive orthochromatic polyester film to be used as a positive working negative in optical work.

NPC stands for a high-sensitive orthochromatic polyester film to be used as a negative in optical work.

All these papers, films and the processing solution are marketed by Agfa-Gevaert N.V. Mortsel, Belgium, under the trade mark COPYPROOF.

The combinations of these materials were used in the following proportions for carrying out the exhaustion tests (i.e. a given number of square meters distributed over a given number of days) of the processing liquid:

80% CPN with
25% CPF, and
75% CPP, and
20% CPRV with
25% CPF, and
75% CPP.

The test results in the table result from the processing of two sheets at the end of each test period, the negative sheet having been exposed to a test wedge with a wedge constant of 0.05, and the resulting image on the positive sheet being measured after separation of the positive from the negative sheet, and its rinsing and drying.

Table 1 reveals the following about the maximum densities $D_{max}$ and the gradations measured for the different combinations and the two processors.

The processing liquid of the prior art processor is exhausted for the use of film after a period of 4 days and processing 4.8 $m^2$ film. As a matter of fact, the transmission density $D_{max}$ measured on film CPF exposed to CPN, CPRV and NPC negatives has dropped to 3.08, 2.86 and 2.87 respectively. In practice a density of at least 3.00 and a gradation of at least 10 are considered as a minimum for a satisfactory film processing.

The use of the processor for paper can go on for some more days, since the reflection density $D_{max}$ measured on paper CPP exposed to CPN and CPRV negatives has dropped to 1.79 and 0.96 respectively after six days. A density of 1.70 and a gradation of 10 are considered as minimum values.

The processing liquid of the new processor on the contrary lasts at least 6 weeks.

Figure 4:
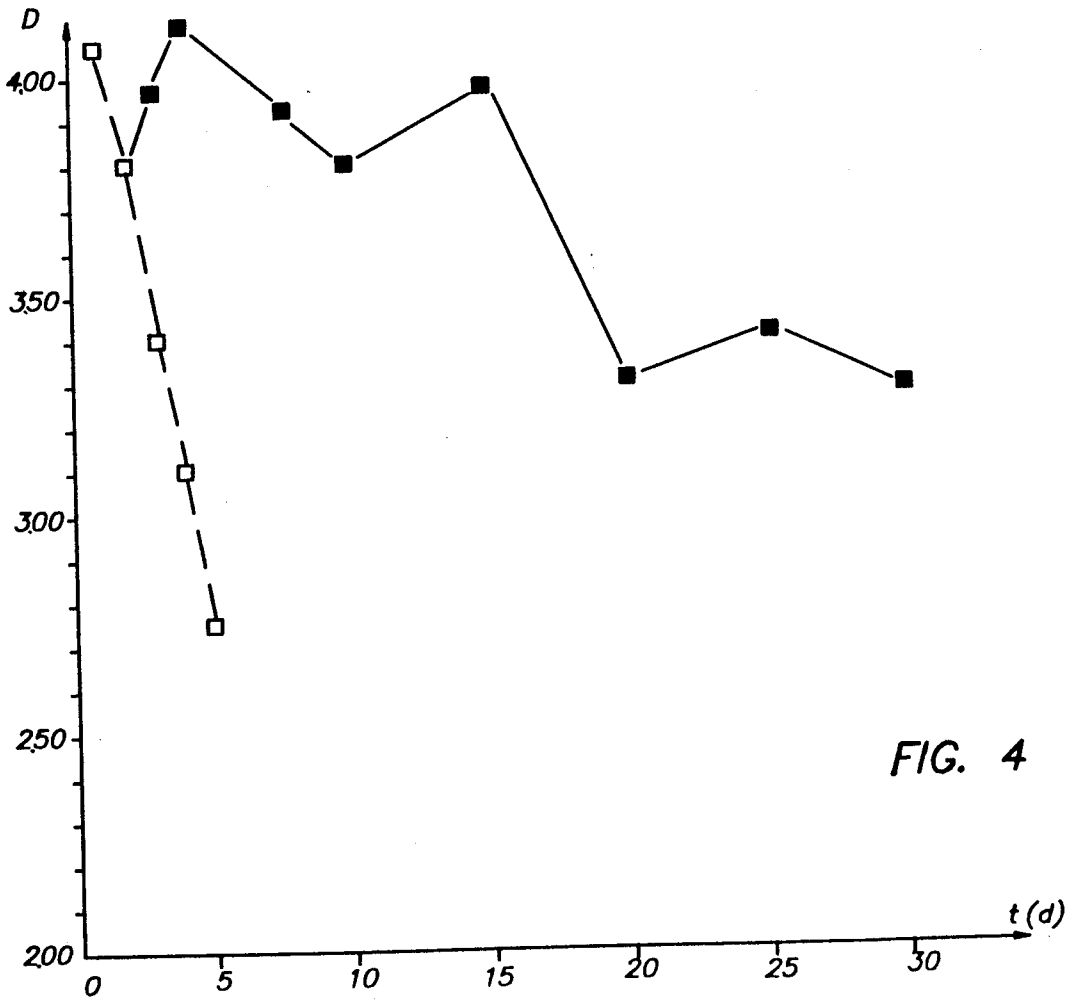
FIG. 4 is a diagram of the evolution of the maximum density of a test sheet processed in a developer, as a function of time.

The comparison of the performance of the developer in the two apparatus is shown in FIG. 4 representing the optical density D measured in transmission as a function of time t expressed in days, for one particular combination of materials, namely CPN5 with CPF5, the open blocks standing for the prior art and the closed ones for the new apparatus.

The yield and the waste of the processing solution calculated per square meter of processed film combination were as follows:

| Processor | old | new |
|---|---|---|
| Use | 4 d | 6 w |
| Yield/$m^2$ | 208 ml | 111 ml |

-continued

| Processor | old | new |
|---|---|---|
| Waste/$m^2$ | 125 ml | 28 ml |

The yield was calculated by dividing the amount of fresh processing solution introduced in the apparatus by the number of processed sq.meters, whereas the waste was the division of the remaining amount of liquid by the processed sq.meters.

Still more information about yield and waste of a developer liquid in the two types of apparatus is given in table 2 wherein the meaning of the different letters is as follows.

A means the amount of processed material in sq.m, B the amount of fresh processing liquid introduced into the apparatus, and C the amount of processing liquid remaining in the apparatus after the processing of the last sheet.

The yield per sq.m is B:A, and the waste per sq.m is C:A.

Although the figures of this table speak for themselves, it is worth mentioning that the yield of the new apparatus can amount to a factor almost two over the prior art one, i.e. 110 ml/$m^2$ versus 208 ml/$m^2$, and that the waste of the new apparatus is approximately 1/5th, i.e. 28 ml/$m^2$ versus 125 ml/$m^2$.

Finally, we have found that the silver content of the developer waste in the new processor amounted to 1400 mg $Ag^+$/l after a period of use of 6 weeks, whereas the prior art apparatus contained only 156 mg $Ag^+$/l after processing for 4 days (4.8 $m^2$). It is clear that the waste liquid of the new processor is paying to recover.

Figure 5:
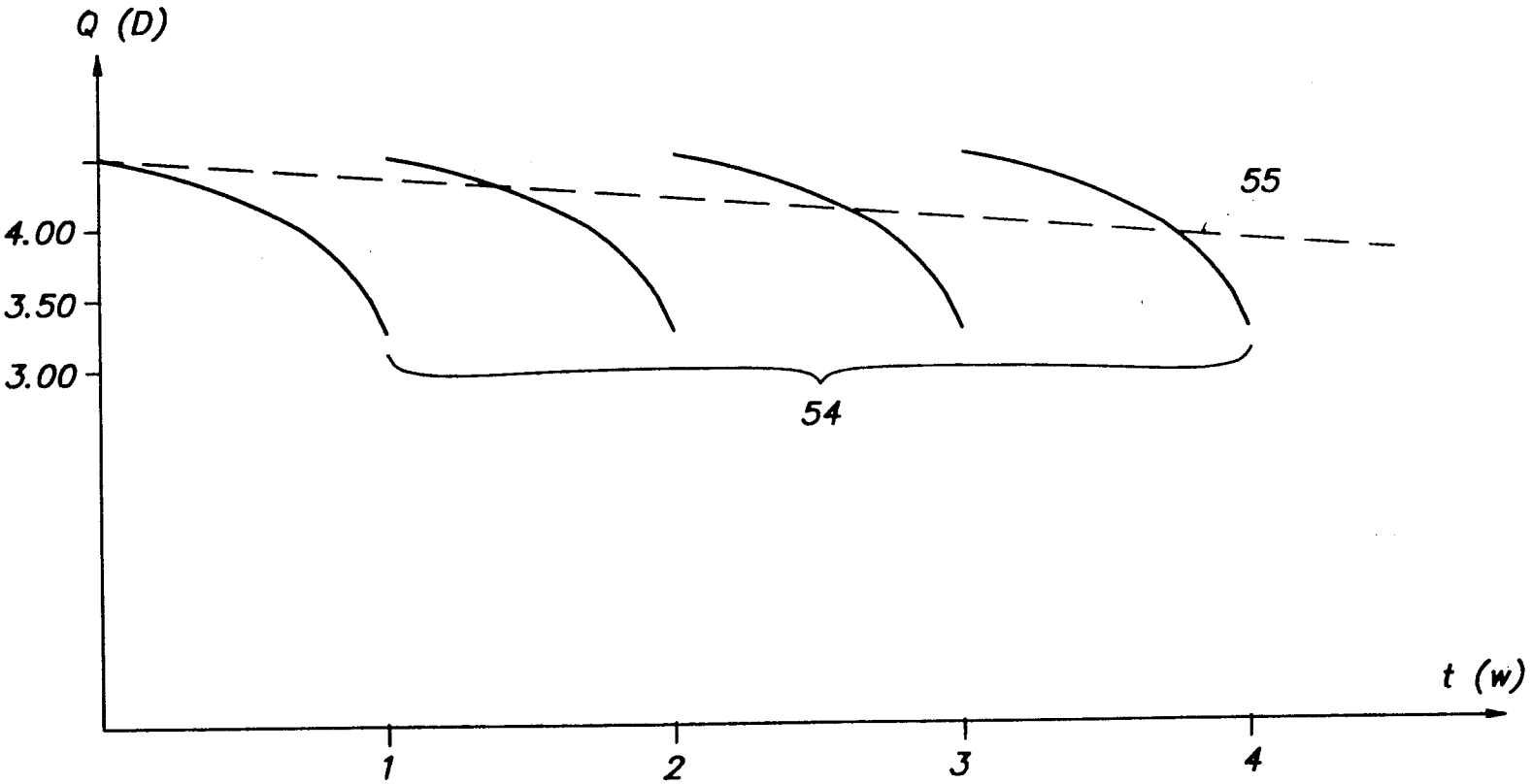
FIG. 5 is a comparative diagram of the quality evolution of processed images.

The evolution of the quality (Q) of the processed images in the new and in the prior art apparatus is depicted in the diagram of FIG. 5 showing the image quality expressed by maximum density D as a function of time. The drawn curves 54 stand for the prior art apparatus cleaned and filled with 1 L of processing solution every week, whereas the broken curve 35 points to the behaviour of the inventive apparatus.

The improvements obtainable for an activator as a processing solution are even more spectacular than for a developer and this is described hereinafter with reference to table 3.

EXAMPLE 2 (WITH ACTIVATOR SOLUTION)

The characteristics of the different photographic materials are as in Table 1, except for the following ones.

The processing solution was type CP296 activator for DTR use, supplied by Agfa-Gevaert N.V., Mortsel-Belgium.

CPF stands for a clear polyester film to be used as a positive for transparancies for overhead projection, intermediate copies for photomechanical processes, etc.

NPC stands for a high-sensitive ortho-chromatic polyester film to be used as a negative in optical reproduction work.

CPTN stands for a high-sensitive ortho-chromatic polyethylene coated paper to be used as a negative in continuous-tone optical work.

Table 3 reveals the following.

The processing liquid of the new processor is not yet completely exhausted after a period of use of 11 weeks (except for the last combination, viz. CPTN with CPP) whereas the prior art processor lasts approximately 6 days. The longer lifetime of the processing solution used for the comparison of table 3, as compared with the results of table 1, is a direct consequence of the use of an activator instead of a developer solution.

Figure 6:
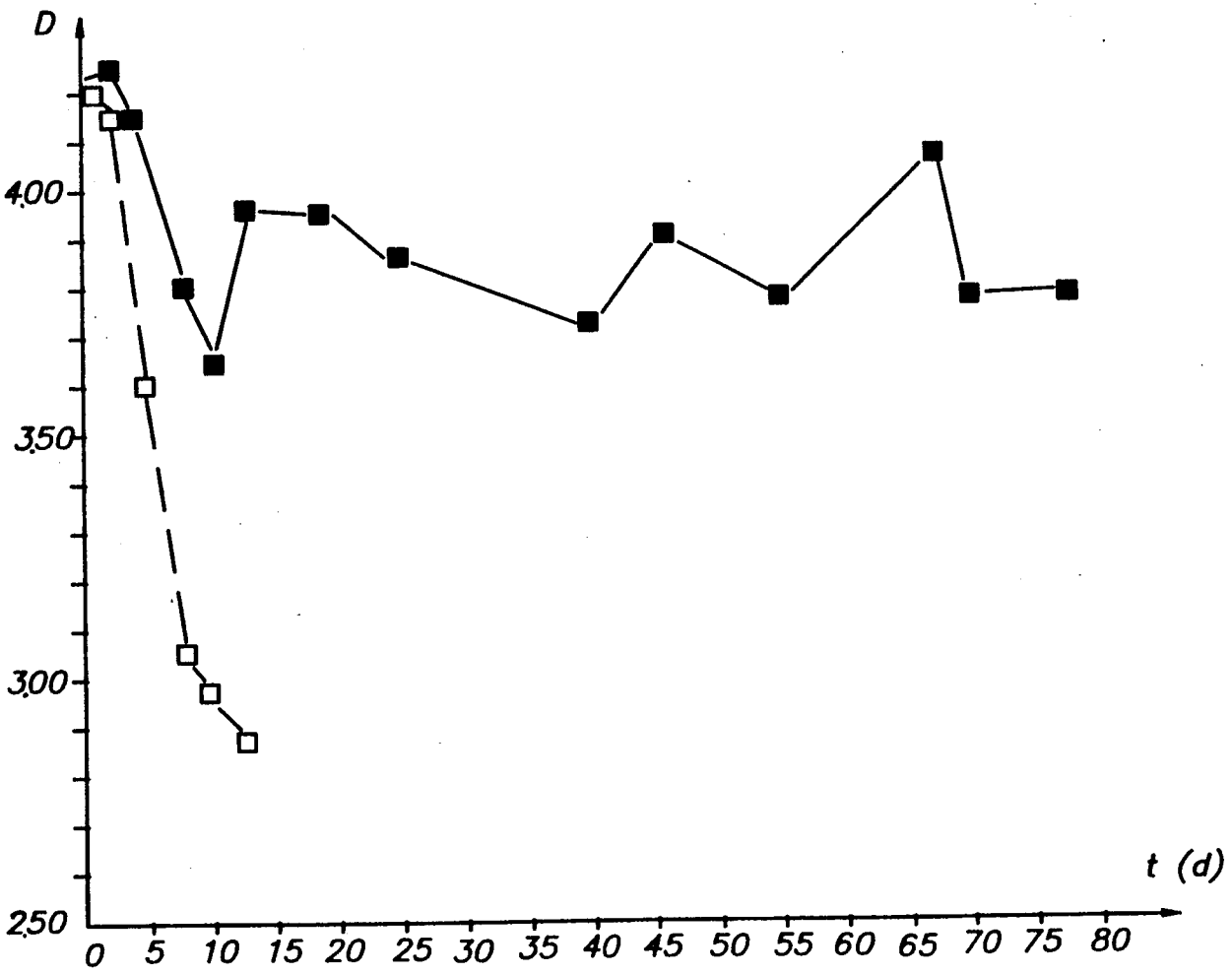
FIG. 6 is a diagram of the evolution of the maximum density of a test sheet processed in an activator, as a function of time.

A comparison of the performance of the activator in the two apparatus is shown in FIG. 6 representing the optical density D measured in transmission as a function of time t expressed in days for one particular combination of materials, namely CPN with CPF.

The yield and the waste of the activator calculated per square meter of the processed combination were as follows:

| Processor | old | new |
|---|---|---|
| Use | 6 d | 77 d |
| Yield/$m^2$ | 139 ml | 103 ml |
| Waste/$m^2$ | 70 ml | 16 ml |

Yield and waste were calculated as mentioned hereinabove.

Still more information about yield and waste of an activator in the two types of apparatus is given in table 4 showing the processing results of different types of material distributed as described hereinbefore. The yield in this example viz. 103 ml/$m^2$ versus 139 ml/$m^2$ is not as large as in the first example, but the reduction of waste viz. 16 ml/$m^2$ versus 70 ml/$m^2$ is comparable with the gain in the first example. However, it should be recognized that the period of servicing the apparatus has been extended up to almost 3 months, which improves the user-friendliness.

The floating cover of the apparatus can have shapes other than the illustrated one. Thus the upper surface of the float can have for instance a convexly curved or a stepped profile. The means for maintaining a spacing between the rear side of the floating cover and the trough can also be provided on the wall of the trough, e.g. in the form of a protruding rib or the like.

The apparatus can be arranged in such a way that the positive sheet is not wetted prior to its contact with the developed negative at the outlet rollers, such as disclosed for instance in DE B1 1.225.489.

The separator plate at the entry of the apparatus may be omitted if a so-called mono-DTR sheet is being processed.

The entry of the apparatus can be provided with a platform for facilitating the introduction of large format sheets into the apparatus.

The bird's fountain system may have another construction than in DE 332104762 referred to. Further it can be replaced by other liquid feeding systems capable of maintaining a constant liquid level. One such system can include a float actuating a valve controlling via a thin flexible tube the air inlet in a barometric feeding container. Such tube may be connected to the adaptor on the neck of such container and communicate via rigid pipe, which may be a capillary, inside of the adaptor for allowing controlled entry of air in the container at a level above that of the liquid in the container. Another system can comprise a float with an electronic sensor for controlling a controller to energize a valve or pump for supplying processing liquid to the trough, etc.

TABLE I

| Time | | $D_{max}$ (gradation) New processor 0 w. 0 $m^2$ | 1 w. 6 $m^2$ | 2 w. 12 $m^2$ | 3 w. 18 $m^2$ | 4 w. 24 $m^2$ | 5 w. 30 $m^2$ | 6 w. 36 $m^2$ | Prior art processor 4 d. 4.8 $m^2$ | 6 d. 7.2 $m^2$ |
|---|---|---|---|---|---|---|---|---|---|---|
| Neg. | Pos. | | | | | | | | | |
| CPN | CPP | 2.01(41 | 1.90(33) | 1.80(33) | 1.82(32) | 1.81(30) | 1.71(27) | 1.75(29) | 2.00(24) | 1.79(13) |
| CPN | CPF | 3.78(16) | 3.86(22) | 3.80(23) | 3.96(22) | 3.28(22) | 3.35(18) | 3.24(20) | 3.08(18) | 2.08(15) |
| CPRV | CPP | 2.11(−27) | 2.06(−25) | 1.97(−27) | 2.00(−17) | 1.99(−16) | 1.96(−17) | 1.97(−19) | 2.05(−17) | 0.96(−7) |
| CPRV | CPF | 4.03(−18) | 3.49(−20) | 3.53(−20) | 3.39(−22) | 3.16(−21) | 3.03(−18) | 3.09(−27) | 2.86(−14) | 1.45(−12) |
| NPC | CPF | 4.95(14) | 4.56(17) | 4.49(17) | 4.24(16) | 3.28(14) | 3.16(13) | 3.16(13) | 2.87(11) | 1.74(8) |

Finally, the silver contents of the waste activator in the new processor amounted to 2000 mg $Ag^+$/l after a period of use of 11 weeks whereas the prior art apparatus contained only 830 mg $Ag^+$/l after 6 days (7.2 $m^2$ processed).

The above two comperative examples clearly demonstrate the advantages of the apparatus and the method according to the present invention. They are not limited to the described embodiment of the inventive processing apparatus, processing solutions and materials used.

The apparatus can be provided with a pair of driven inlet rollers, in addition to the outlet rollers, to ensure the transport of (a) sheet(s) through the processor.

The apparatus can be provided with heating means controlled by a temperature sensor to maintain the processing solution at a constant temperature.

TABLE 2

| Aspects | New Processor | | | | | Prior art processor |
|---|---|---|---|---|---|---|
| Time | 2 w. | 3 w. | 4 w. | 5 w. | 6 w. | 4 d. |
| A (in $m^2$) | 12 | 18 | 24 | 30 | 36 | 4.8 |
| B (in l) | 2.2 | 2.9 | 3.3 | 3.6 | 4.0 | 1.0 |
| C (in l) | 1.0 | 1.0 | 1.0 | 1.0 | 1.0 | 0.6 |
| Yield (in ml/$m^2$) | 183 | 161 | 138 | 120 | 110 | 208 |
| Waste (in ml/$m^2$) | 83 | 55 | 42 | 33 | 28 | 125 |

TABLE 3

| Time After | | $D_{max}$ (gradation) New processor 0 w. 0 $m^2$ | 2 w. 12 $m^2$ | 3 w. 18 $m^2$ | 4 w. 24 $m^2$ | 5 w. 30 $m^2$ | 7 w. 42 $m^2$ | 11 w. 66 $m^2$ | Prior art processor 6 d. 7.2 $m^2$ |
|---|---|---|---|---|---|---|---|---|---|
| Neg. | Pos. | | | | | | | | |

TABLE 3-continued

| | | $D_{max}$ (gradation) | | | | | | | |
|---|---|---|---|---|---|---|---|---|---|
| | | New processor | | | | | | | Prior art processor |
| Time After | | 0 w. 0 $m^2$ | 2 w. 12 $m^2$ | 3 w. 18 $m^2$ | 4 w. 24 $m^2$ | 5 w. 30 $m^2$ | 7 w. 42 $m^2$ | 11 w. 66 $m^2$ | 6 d. 7.2 $m^2$ |
| CPN | CPF | 4.21(20) | 3.96(18) | 3.95(18) | 3.86((18) | 3.67(18) | 3.88(18) | 3.77(20) | 305(15) |
| NPC | CPF | 4.78(17) | 458(11) | 382(12) | 3.91(12) | 4.04(10) | 3.80(11) | 4.20(15) | 2.94(9) |
| CPN | CPP | 1.89(37) | 1.81(35) | 1.78(30) | 1.78(28) | 1.77(23) | 1.65(30) | 1.70(24) | 1.84(20) |
| CPTN | CPP | 1.75(1.7) | 1.73(2.3) | 1.70(1.9) | 1.71(2.0) | 1.61(1.7) | 1.60(1.8) | 1.56(1.6) | 1.32(1.5) |

TABLE 4

| Aspects | New Processor | | | | | | Prior art processor |
|---|---|---|---|---|---|---|---|
| Time | 3 w. | 43 w. | 5 w. | 6 w. | 7 w. | 11 w. | 6 d. |
| A (in $m^2$) | 18 | 24 | 30 | 36 | 42 | 66 | 7.2 |
| B (in l) | 2.8 | 3.4 | 3.8 | 4.3 | 4.8 | 6.8 | 1.0 |
| C (in l) | 1.0 | 1.0 | 1.0 | 1.0 | 1.0 | 1.0 | 0.5 |
| Yield (in ml/$m^2$) | 155 | 142 | 130 | 119 | 114 | 103 | 139 |
| Waste (in ml/$m^2$) | 55 | 42 | 33 | 28 | 24 | 16 | 70 |

We claim:

1. Processing apparatus for processing an image-wise exposed silver salt diffusion transfer sheet material comprising a trough (11) for processing liquid, the bottom wall (13) of which is concavely curved to serve as a guide for a sheet through liquid in the trough, the trough being provided with a sloping entry guide plate (17) for guiding a sheet towards its deepest point, a pair of outlet rollers (16) for pulling the sheet at a uniform speed through the apparatus and for squeezing liquid from it and replenishing means for keeping a processing liquid in the trough at a controlled level, characterized in that the apparatus is provided with a floating cover (25) arranged for floating on the free processing liquid surface extending between the rear end (24) of the trough and the guide plate (17), and means for maintaining between the rear side (27) of the floating cover and the corresponding rear end of the trough a spacing (41) with sufficient clearance to allow passage of a sheet along the bottom wall towards the outlet rollers.

2. Processing apparatus according to claim 1, wherein said spacing means is provided on the floating cover (25).

3. Processing apparatus according to claim 2, wherein said spacing means is formed by a protrusion (39,40) at each corner of the rear end of the floating cover (25).

4. Processing apparatus according to claim 1 wherein said floating cover has a lateral extension (32) covering a corresponding extension (34) of the trough, leading to a provision (35) for emptying it.

5. Processing apparatus according to claim 1, wherein the front and rear side (21,27) of the floating cover are bevelled and taper in downward direction.

6. Processing apparatus according to claim 1, wherein said floating cover (25) has a top surface tapering towards the peripheral edge.

7. Processing apparatus according to claim 1, wherein said floating cover (25) has a grip (28) for easy removal of the cover from the apparatus.

8. A method for the production of photographic images in accordance with the DTR method, wherein an image-wise exposed light-sensitive sheet is processed by introduction into a body of processing liquid, contained in an open trough, by means of a slanting guide at the entry of this trough and its conveyance along a cocavely curved path through said body of processing liquid, characterized by the steps of reducing the free liquid surface comprised between the line of intersection of said liquid surface with the sheet guide plate and the rear end of the trough by floating means closely spaced from the adjacent walls of the trough, and controlling the level of the processing liquid in the trough to keep the vertical position of the floating means in the trough constant.

9. A method according to claim 8, comprising controlling the level of the liquid by means of a bird's fountain system.

10. A method according to claim 8, comprising controlling the level of the processing liquid to keep deviations thereof smaller than 1.5 mm.

* * * * *